US012635834B2

(12) United States Patent
Poulin et al.

(10) Patent No.: US 12,635,834 B2
(45) Date of Patent: May 26, 2026

(54) DUST COLLECTOR

(71) Applicants: Jimmy Poulin, Aston-Jonction (CA); Richard Roy, Aston-Jonction (CA)

(72) Inventors: Jimmy Poulin, Aston-Jonction (CA); Richard Roy, Aston-Jonction (CA)

( * ) Notice: Subject to any disclaimer, the term of this patent is extended or adjusted under 35 U.S.C. 154(b) by 77 days.

(21) Appl. No.: 18/652,641

(22) Filed: May 1, 2024

(65) Prior Publication Data

US 2024/0366041 A1 Nov. 7, 2024

(30) Foreign Application Priority Data

May 5, 2023 (GB) ..... 2306722

(51) Int. Cl.
*A47K 10/38* (2006.01)

(52) U.S. Cl.
CPC ..... *A47K 10/38* (2013.01); *A47K 2010/389* (2013.01)

(58) Field of Classification Search
USPC ..... 242/596.8, 598.6
See application file for complete search history.

(56) References Cited

U.S. PATENT DOCUMENTS 1,414,443 A 5/1922 Steiner
1,423,336 A * 7/1922 Korittke ..... A47K 10/34 225/53
2,253,744 A * 8/1941 Witt ..... B65H 35/0006 225/42
2,276,414 A * 3/1942 Morehouse ..... A47K 10/3827 225/53
2,668,022 A * 2/1954 Fairfield ..... A47K 10/38 225/41
2,798,597 A * 7/1957 Thompson ..... B65D 85/671 220/840
2,834,557 A 5/1958 Graham
4,089,481 A * 5/1978 Ciuci ..... A47K 10/40 242/598.6
4,467,974 A * 8/1984 Crim ..... A47K 10/3809 242/419.4
4,706,904 A * 11/1987 Raymond ..... G03B 27/588 242/596.8
4,770,679 A 9/1988 Slaughter
5,170,958 A 12/1992 Brown
5,439,521 A * 8/1995 Rao ..... A47K 10/3827 242/598.6
5,642,810 A * 7/1997 Warner ..... B65D 83/0805 220/4.23

(Continued)

FOREIGN PATENT DOCUMENTS

CN 106903114 6/2017
CN 112958576 6/2021

(Continued)

*Primary Examiner* — William A. Rivera

(57) ABSTRACT

A dust collector mountable adjacent a toilet paper dispenser exit defined by an enclosure of a dispenser usable for dispensing toilet paper from a roll, the dust collector comprising an abutting portion for abutting against the toiler paper and a recessed portion extending substantially parallel to the abutting portion and recessed relative to the abutting portion, the recessed portion having a dust adhering surface facing the toilet paper in use and configured to adhere to adjacent airborne dust. Also, a toilet paper dispenser including the dust collector.

19 Claims, 2 Drawing Sheets

(56) References Cited

U.S. PATENT DOCUMENTS

| | | | | |
|---|---|---|---|---|
| 5,660,313 | A * | 8/1997 | Newbold | A47K 10/32 242/598.6 |
| 5,741,352 | A | 4/1998 | Ford et al. | |
| 6,098,836 | A * | 8/2000 | Gottselig | A47K 10/3818 221/45 |
| 6,446,808 | B1 * | 9/2002 | Paul | A47K 10/3827 206/409 |
| 6,857,540 | B2 * | 2/2005 | Mitchell | A47K 10/38 221/45 |
| D603,635 | S * | 11/2009 | Krebs | D6/518 |
| D616,233 | S * | 5/2010 | Yang | D6/518 |
| 8,584,982 | B2 | 11/2013 | Eakin | |
| 8,967,523 | B2 * | 3/2015 | Huang | A47K 10/3827 242/405 |
| 2005/0156081 | A1 * | 7/2005 | Schaeffer | A47K 10/38 242/598.6 |
| 2009/0246022 | A1 * | 10/2009 | Huang | F04D 29/185 417/247 |
| 2012/0211587 | A1 * | 8/2012 | Caldwell | B65H 49/325 242/598 |
| 2013/0118973 | A1 | 5/2013 | Seo et al. | |

FOREIGN PATENT DOCUMENTS

| | | |
|---|---|---|
| GB | 482366 | 3/1938 |
| JP | 11206616 | 8/1999 |
| JP | 2017225789 | 12/2017 |
| JP | 2021137465 | 9/2021 |
| JP | 2022124572 | 8/2022 |
| JP | 2022124573 | 8/2022 |
| KR | 2004016465 | 2/2004 |
| KR | 2016039075 | 4/2016 |

* cited by examiner

DUST COLLECTOR

FIELD OF THE INVENTION

The present invention relates to the general field of dust collecting devices and, more particularly, to a dust collector adapted for collecting dust particles generated when rolled sheet material, such as toilet paper and other similar materials, is pulled from a dispenser.

BACKGROUND

Rolled sheet material, such as, non-limitingly, toilet paper, often generates dust when unrolled. This dust can be relatively small, and therefore difficult to collect if one wants to avoid its dispersal. One manner of reducing the propagation of such dust is to enclose the roll of material in an enclosure defining a slot through which the material is dispensed. The dust can then settle in the enclosure. However, some of the dust may escape through the slot. Also, some of the dust my adhere to the dispensed material and be re-suspended outside of the enclosure.

Thus, there is a need on the market for an improved dust collector. An object of the present invention is to provide such an improved dust collector, for example usable for collecting toilet paper dust particles.

SUMMARY OF THE INVENTION

In a broad aspect, there is provided a dispenser for dispensing toilet paper from a roll, the dispenser comprising: an enclosure for receiving the roll of toilet paper, the enclosure defining an elongated toilet paper dispenser exit for dispensing the toilet paper therethrough; a dust collector mounted along the toilet paper dispenser exit, the dust collector being configured to collect dust released as the toilet paper is unrolled from the roll.

In some embodiments, the dust collector may collect a major portion, most or all of the dust released when the toilet paper as the latter is dispensed.

There may also be provided a dispenser wherein the enclosure defines a pair of substantially parallel dispensing walls leading to the toilet paper dispenser exit, the dust collector being received between the dispensing walls.

There may also be provided a dispenser wherein the toilet paper dispenser exit is narrower than a thickness of the dust collector.

There may also be provided a dispenser wherein the dust collector is removable from between the dispensing walls.

There may also be provided a dispenser wherein the dust collector and the enclosure define together a mating protrusion and recess structure for preventing movements of the dust collector relative to the dispensing walls.

There may also be provided a dispenser wherein, in operation, the toilet paper dispenser exit faces downwardly and the dust collector and at least one of the dispensing walls define a recess therebetween opposed to the toilet paper dispenser exit for collecting thereinto dust settling in the enclosure.

There may also be provided a dispenser wherein the dust collector is configured and sized to abut against the toilet paper as the latter is dispensed through the toilet paper dispenser exit.

There may also be provided a dispenser wherein the dust collector defines an abutting portion extending along the toilet paper dispenser exit for abutting against the toiler paper and a recessed portion extending substantially parallel to the abutting portion and recessed relative to the abutting portion, the recessed portion having a dust adhering surface facing the toilet paper in use configured to adhere to adjacent airborne dust.

There may also be provided a dispenser wherein the abutting portion includes a fibrous material and the adhesive portion includes a silicone material.

There may also be provided a dispenser wherein, in operation, the abutting portion is above the recessed portion.

There may also be provided a dispenser wherein the abutting portion is configured to frictionally engage the toilet paper with a predetermined force, the predetermined force being sufficient to dislodge at least partially adhered dust adhered to the toilet paper as the latter is dispensed.

There may also be provided a dispenser wherein the dust collector includes a pair of facing abutting portions extending along the toilet paper dispenser exit for pinching the toilet paper therebetween when the latter is dispensed.

There may also be provided a dispenser wherein the dust collector is washable.

In another broad aspect, there is provided a method of collecting dust created when toilet paper is dispensed through a toilet paper dispenser exit provided at a bottom of an enclosure in which the toilet paper is located, the method comprising the steps of: a) collecting suspended dust in suspension in the enclosure; b) dislodging adhered dust adhered to the toilet paper before the latter exits from the toilet paper dispenser exit; and c) adhering airborne dust dislodged at step b).

In yet another broad aspect, there is provided a dust collector mountable adjacent a toilet paper dispenser exit defined by an enclosure of a dispenser usable for dispensing toilet paper from a roll, the dust collector comprising an abutting portion for abutting against the toiler paper and a recessed portion extending substantially parallel to the abutting portion and recessed relative to the abutting portion, the recessed portion having a dust adhering surface facing the toilet paper in use and configured to adhere to adjacent airborne dust.

There may also be provided a dust collector wherein the dust collector defines a slanted top surfaces.

There may also be provided a dust collector wherein the abutting portion includes a fibrous material and the adhesive portion includes a silicone material.

There may also be provided a dust collector wherein, in operation, the abutting portion is above the recessed portion.

There may also be provided a dust collector wherein the abutting portion is configured to frictionally engage the toilet paper with a predetermined force, the predetermined force being sufficient to dislodge at least partially adhered dust adhered to the toilet paper as the latter is dispensed.

There may also be provided a dust collector wherein the abutting portion is a first abutting portion, the dust collector including a second abutting portion facing the first abutting portion, the first and second abutting portions being configured for receiving the toilet paper therebetween when the toilet paper is dispensed and pinching the toilet paper to dislodge dust particles adhered thereto.

The present application claims priority from UK patent application GB2306722.6 filed May 5, 2024, the contents of which is hereby incorporated by reference in its entirety.

Advantageously, in some embodiments, the proposed dust collector can collect dust relatively efficiently at relatively low costs.

Other objects, advantages and features of the present invention will become more apparent upon reading of the following non-restrictive description of some embodiments thereof, given by way of example only with reference to the accompanying drawings.

DETAILED DESCRIPTION

Figure 4:
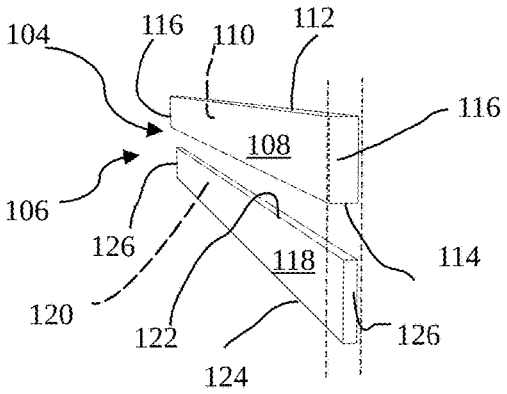
FIG. 4, in a side perspective view, illustrates the two dust collecting components shown in FIG. 2 in the form of a dust filtering element above a dust adhering element.
Figure 5:
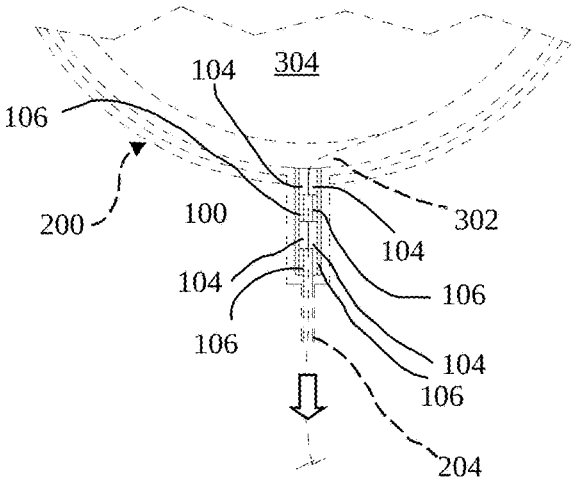
FIG. 5, in a side cut-away view, illustrates the dust collector of FIG. 1 mounted in a toilet paper dispenser housing.
Figure 6:
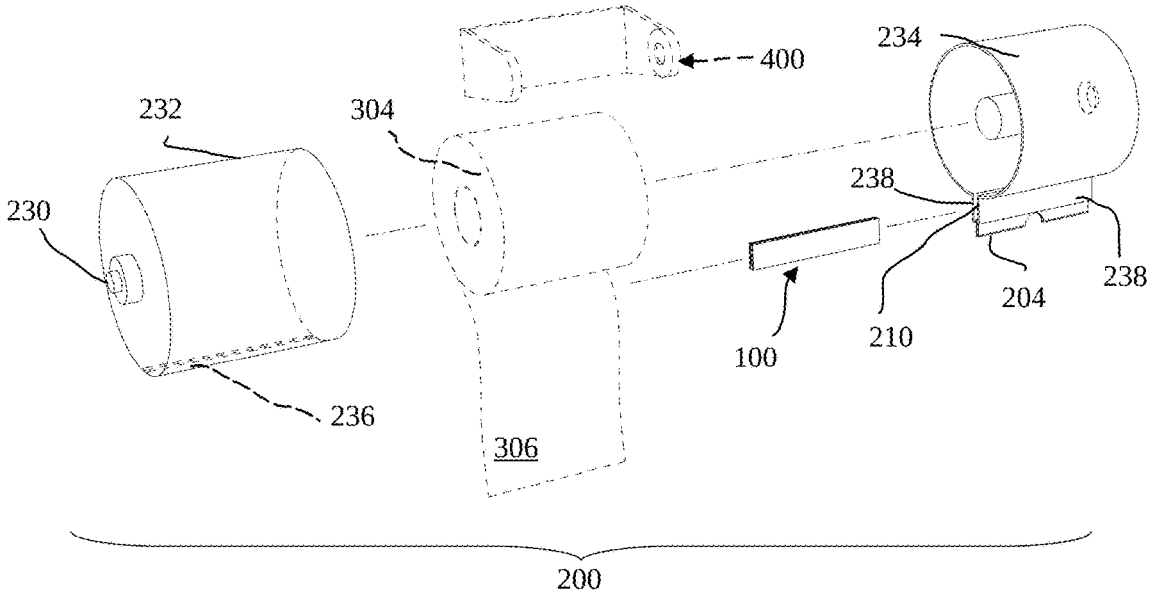
FIG. 6, in a perspective exploded view, illustrates an embodiment of a dust collector including a two parts toilet paper dispenser housing adapted for mounting in a standard toilet paper support bracket.

FIGS. 1 to 9 collectively illustrate various aspects of embodiments, according to the present invention, of a dust collector 100, 100', 100" and 100'" for collecting toilet paper dust particles 300 from a length of toilet paper 302 pulled from a toilet paper dispenser 200. The dust collector 100 is usable to eliminate, or at least significantly minimize, the presence of toilet paper dust particles 300 that typically accumulate on the floor below the toilet paper dispenser 200 when no dust collector 100, 100', 100" and 100" is present. The toilet paper dispenser 200 typically contains a predetermined quantity of stored toilet paper in the form of a toilet paper roll 304 (as illustrated in FIG. 6).

Figure 9:
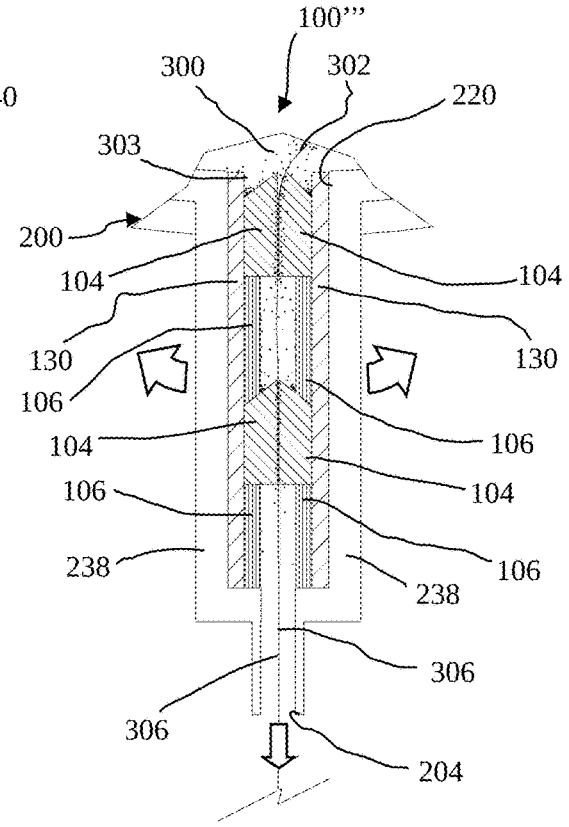
FIG. 9, in an enlarged, side cut-away view, illustrates another embodiment of a dust collector including dust filtering element having a slanted upper edge.

With reference to FIG. 9, the toilet paper has a conventional thin ribbon-like configuration defining two opposite toilet paper surfaces 306. The toilet paper dispenser 200 defines a toilet paper dispenser exit 204 through which is dispensed the toilet paper, typically in the form of an elongated slot. Furthermore, an intermediate portion of the length of toilet paper 302 to be pulled out of the toilet paper dispenser 200 extends between the predetermined quantity of stored toilet paper and the toilet paper dispenser exit 204.

Figure 2:
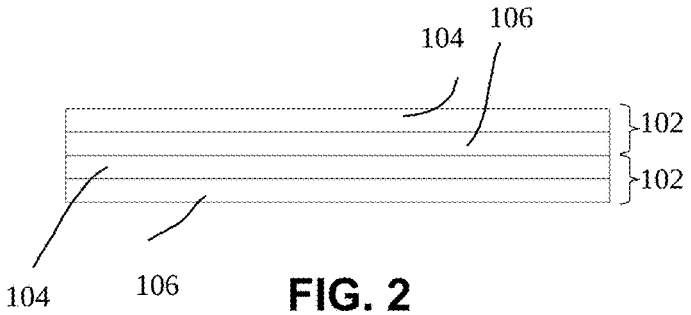
FIG. 2, in a front elevational view, illustrates two dust collecting components part of the dust collector of FIG. 1 disposed one above the other.
Figure 3:
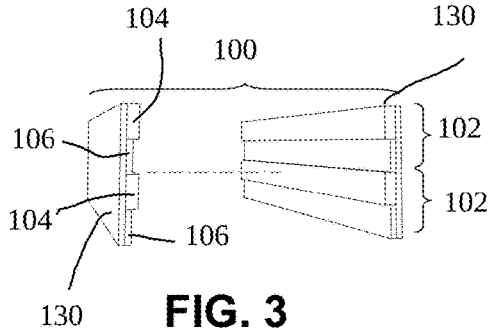
FIG. 3, in a side perspective view, two pairs of dust collecting components similar to the dust collecting components of FIG. 2 facing one another.

Referring now more particularly to FIGS. 2, 3 and 4, the dust collector 100 comprises at least one dust collecting component 102. Each one in the at least one dust collecting component 102 is connected mounted to a toilet paper dispenser housing, or enclosure, 201 of to the toilet paper dispenser 200 and located along the intermediate portion of the length of toilet paper 302 to be pulled from the toilet paper dispenser 200. Furthermore, each one in the at least one dust collecting component 102 is located substantially adjacent to one or both of the two opposite toilet paper surfaces 306. Typically, the at least one dust collecting component 102 is configured and sized so that at least part thereof abuts against the toilet paper as the latter is dispensed through the toilet paper dispenser exit 204.

Each dust collecting component 102 includes a dust filtering element 104, or abutting portion, for filtering and collecting toilet paper dust particles 300, typically by abutting against the toilet paper, and a dust adhering element 106 for adhering to, and collecting airborne toilet paper dust particles 300 contacting therewith. The dust adhering element 106 is recessed relative to the dust filtering element 104, and defines a dust adhering surface 118 facing the toilet paper in use configured to adhere to adjacent airborne toilet paper dust particles 300. Due to the recessed configuration of the dust adhering element 106, the latter has at least a portion thereof that is spaced apart from the toilet paper surfaces 306 in use.

The dust filtering element 104 has a substantially elongated configuration defining respectively opposed proximal and distal longitudinal surfaces 108 and 110 relative to the respective toilet paper surface 306. The dust filtering element 104 further defines opposed upper and lower longitudinal surfaces 112 and 114, and opposed longitudinal ends 116 each extending therebetween.

The dust filtering element 104 is typically sufficiently sized and shaped so as to extend longitudinally parallelly and substantially transversally the whole width of the respective toilet paper surface 306. Furthermore, the dust filtering element 104 has its proximal longitudinal surface 108 located so as to effect a substantially light rubbing action against the respective toilet paper surface 306. More specifically, the dust filtering element 104 is configured to frictionally engage the toilet paper surface 306 with a predetermined force, the predetermined force being sufficient to dislodge at least partially adhered dust adhered to the toilet paper surface 306 as the latter is dispensed.

The dust adhering element 106 has a substantially elongated configuration defining respectively opposed dust adhering surface 118, or proximal longitudinal surface, and distal longitudinal surface 120 relative to the respective toilet paper surface 306. Furthermore, the dust adhering element 106 defines opposed upper and lower longitudinal surfaces 122 and 124, and opposed longitudinal ends 126 extending therebetween.

The dust adhering element 106 is typically sufficiently sized and shaped so as to extend longitudinally parallelly and substantially transversally the whole width of the respective toilet paper surface 306. Furthermore, the dust adhering element 106 has its dust adhering surface 118 located so as to be at least in slightly spaced apart relationship relative to the respective toilet paper surface 306, as best illustrated in FIG. 4. In the figures, the distance between the dust adhering surface 118 and the toilet paper surface 306 has been at least slightly exaggerated for illustrative purpose, as this distance is typically relatively small. The dust adhering element 106 is located longitudinally parallelly under the dust filtering element 104 such that the upper longitudinal surface 112 of the dust adhering element 106 is at least substantially proximally adjacent the lower longitudinal surface 114 of the dust filtering element 104.

Two or more dust collecting component 102 may be provided along a same one of the two opposite toilet paper surfaces 306, located longitudinally parallelly, and at least substantially proximally juxtaposed one above the other.

As best illustrated in FIG. 9, when the length of toilet paper 302 is pulled out from the toilet paper dispenser exit 204 of the toilet paper dispenser 200, in a first step, toilet paper dust particles 300 are captured as they are simply released from the toilet paper 302 and become airborne as the toilet paper 302 is unrolled or unfolded from the toilet paper stored in the toilet paper dispenser 200. Once airborne, a portion of these toilet paper dust particles 300 then gradually fall by gravity and are collected on top of the upper longitudinal surface 112 of the uppermost dust filtering element or elements 104 of the dust collector 100.

In a second step, additional toilet paper dust particles 300 that still adhere relatively weakly to the two opposite toilet paper surfaces 306 may then be substantially rubbed away by, and collected within, the forward surface 108 of each dust filtering element 104 abuttingly rubbing against its respective toilet paper surface 306.

In a third step, additional toilet paper dust particles 300 that have not been captured by the overlying dust filtering element 104 and managed to become airborne bellow the junction between the latter and the toilet paper surface 306, may adhere to the dust adhering surface 118 of the dust adhering element 106.

Finally, in a dust collector 100 comprising additional dust collector components 102 located serially below a first dust collector component 102 along a same toilet paper surface 306, the steps one to three above are repeated a corresponding number of times regarding the remaining paper dust particles 300 that have not been captured by the preceding dust collector component 102 and could still be relatively easily rubbed off the respective toilet paper surface 306.

Thus, advantageously, the dust collector 100 of the present invention allows three different types of dust collecting actions, namely by gravity, dust filtering and dust adhering actions, that are effected in series along at least one surface of a length of toilet paper 302 actively pulled out of a toilet paper dispenser 200 equipped therewith.

The effectiveness of the dust collector 100 can be further optimized with additional dust collecting components 102 disposed vertically serially below one another along a same toilet paper surface 306 of the dispensed toilet paper.

Although the present invention as been described in relation with toilet paper stored in the form of a conventional roll of toilet paper, it is to be understood that the same invention may be used in a toilet paper dispenser (not shown in the figure) in which an elongated, or continuous ribbon of toilet paper is stored in an another form such as, for example, in a compact accordion-like folding pattern, or equivalent. Further advantageously, it is to be understood that the present invention may be just as easily adapted for other applications involving a roll of sheet like material typically generating dust particles each time a length thereof is unrolled from a dispenser. For example, the present invention may be adapted for a roll of kitchen paper towel rollably suspended on its support bracket, or equivalent. Other adaptations of the present invention may apply in assembly lines of product in the manufacturing industry that are dispensed similarly to toilet paper and similar materials, for example by being unrolled from a roll.

Figure 8:
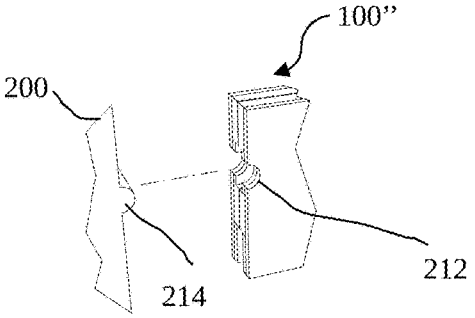
FIG. 8, in a side perspective cut-away partial view, illustrates a protrusion and recess arrangement between an edge of a dust collector and an inner surface of a toilet paper dispenser housing.

As best exemplified in FIGS. 3 and 8, typically, the dust collector 100 of the present invention comprises two dust collecting components 102 one above the other along each opposite toilet paper surfaces 306 of the length of toilet paper 302 to be pulled from the toilet paper dispenser 200. Also, the thus paired dust collecting components 102 on each toilet paper surfaces 306 are oppositely in register relative to one another as illustrated in the figures. Other relative positions of the dust collecting components along each opposed surfaces of the length of toilet paper 302 are also possible.

The dust filtering element 104 can be made of any dust particle filtering material or an assembly of materials known in the filtering component industry such as, but not limited to, fibrous materials, such as a synthetic or natural microfiber, a dense mesh of filaments, parallel brush bristles, a dense fabric, a sponge-like material, or a combination thereof. The dust adhering element 106 can be made of any dust particle adhering material, substance, or an assembly of such materials or substances known in dust adhering and filtering technologies such as, but not limited to, a silicon material having a relatively high coefficient of adherence, an adhesive substance on a support means, or any equivalent adhering substance or gel-like material.

Referring more particularly to FIGS. 2, 3 and 9, all the dust filtering and adhering elements 104 and 106 located along a same toilet paper surface 306 are typically disposed in a parallel arrangement relative to one another so as to form a unified assembly. The unified assembly of these elongated and parallelly extending elements may be achieved through any known suitable means of assembly such as, but not limited to, an adhesive or a thermal bonding process applied between the oppositely facing upper and lower longitudinal surfaces of the elements. For example, as illustrated in the figures, the dust filtering and adhering elements 104 and 106 are firmly connected to one another through being glued, thermally bonded, or otherwise firmly connected to a water resistant rear support backing sheet 130 so as to be washable. The rear support backing sheet 130 may be made of any suitably water resistant material such as a plastic, vinyl or silicon sheet of material, a synthetic fabric, a sealed cardboard sheet, or the likes.

Typically, as exemplified in FIG. 6, the dust collector 100 is user selectively removably mounted in the toilet paper dispenser 200, so as to allow the user to periodically remove, rinse with water the accumulated toilet paper dust particles 300, and then reinstall, the dust collector 100 in the toilet paper dispenser 200.

For example, the dust collector 100 may be removably mounted in a cavity 220 defined by a pair of substantially parallel dispensing walls 238 leading to the toilet paper dispenser exit 204 accessible through an opening 210 at one lateral end of the toilet paper dispenser 200, as illustrated, or through an elongated opening through the housing and located parallelly adjacently along the upper or lower longitudinal edges of the dust collector 100. Furthermore, the dust collector 100 may be removably maintained in the cavity 220 through any suitable means such as Velcro, paired magnetic elements or, as exemplified in FIG. 8, through a mating protrusion and recess arrangement 212 and 214 between the longitudinal end edges of an alternative collector 100" and inner side surfaces of the cavity 220 for preventing movements of the dust collector 100" relative to the dispensing walls 238. Other means of removably maintaining the dust collector in the cavity 220 are also possible. The dust collector 100" is typically prevented from being dragged trough the toilet paper dispenser exit 204 by the dimensions of the latter, which is typically narrower than a thickness of the dust collector 100".

Figure 7:
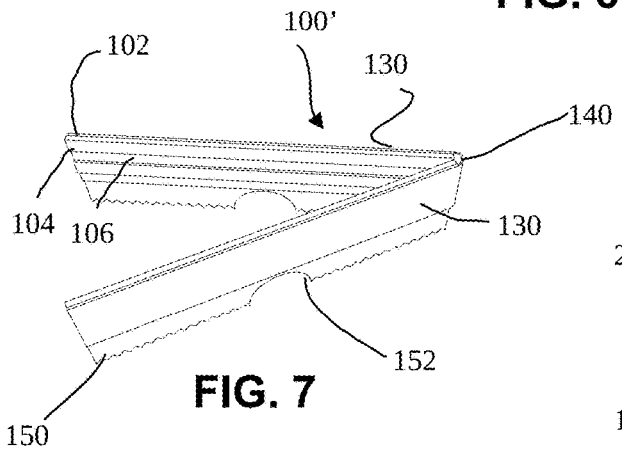
FIG. 7, in a top perspective view, illustrates another embodiment of a dust collector including two paired dust collecting components joined to each other.

Referring to FIG. 7, in some embodiments of the invention, the dust collector 100' comprises at least one dust collecting component 102 on each opposed toilet paper surfaces 306 for pinching the toilet paper therebetween when the latter is dispensed. The dust collector 100' further comprises a link portion 140 joining both dust collecting components 102 at one end thereof. Typically, the link portion 140 is at least slightly flexible to facilitate a washing operation of the dust collector 100.

Still referring to FIG. 7, in some embodiments of the invention, the dust collector 100 further comprises a toilet paper cutting edge 150 defining a centred thumb recess 152, which is extending substantially distally downwardly from the lower longitudinal edge 124 of the lowest dust adhering element or elements 106 thereof.

The surface area of, and relative surface proportion between, the forward longitudinal surfaces 108 and 118, of each one of the dust filtering and adhering elements 104 and 106 respectively, may be suitably selected so as to optimize the overall efficiency of the dust collector 100 applied to a particular application, such as in a toilet paper dispenser 200.

For example, the respective surface areas of the forward longitudinal surfaces 108 and 118, of each one of the dust filtering and adhering elements 104 and 106 respectively, are suitably selected such that the overall vertical dimension of the dust collector 100 is roughly between one and five centimetres. Thus, the toilet paper dispenser 200 provided with the dust collector 100 represents a relatively small and compact overall assembly. Other overall height dimensions for the dust collector 100 are also possible.

Figure 1:
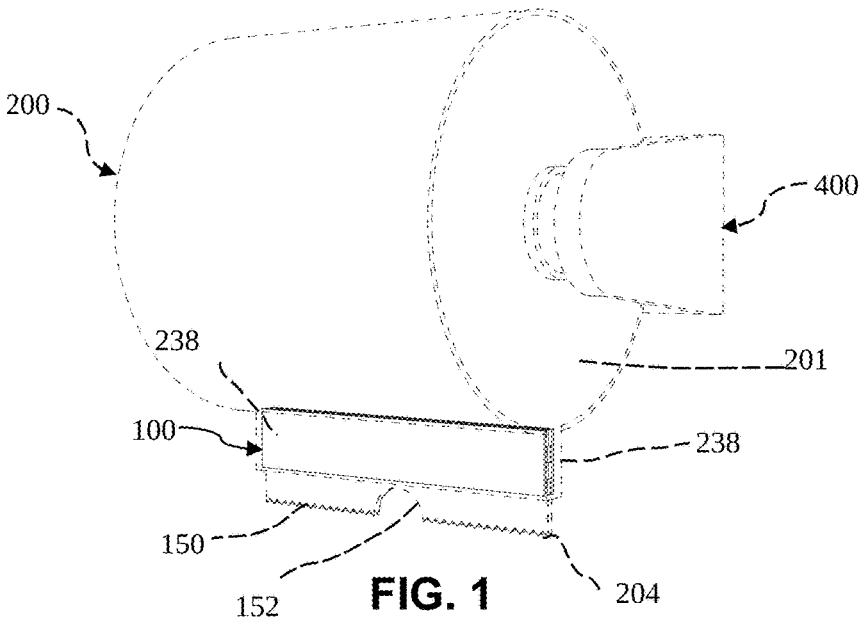
FIG. 1, in a perspective view, illustrates an embodiment of a dust collector, according to the present invention.

Still referring to FIGS. 1, 5 and 6, in an alternate embodiment, according to the present invention, the dust collector 100 further comprises a toilet paper dispenser housing 201, or enclosure, sufficiently dimensioned for receiving a toilet paper roll 304 in a closed compartment. The toilet paper dispenser housing 201 is provided with a suitably sized toilet paper dispenser exit 204 through which extends at least an end edge portion of the toilet paper to be dispensed. The toilet paper dispenser housing 201 is suitably sized, configured and provided with well known spring biased axis end buttons 230 at each longitudinal ends thereof, so as to be removably mountable on a standard wall mounted paper roll support bracket 400, as best exemplified in FIG. 6.

In one embodiment of the toilet paper dispenser housing 201, such as the one illustrated, the toilet paper dispenser housing 201 includes two open ended cylindrical components 232 and 234 configured in a telescopic assembly. One of the cylindrical components 232 defines a suitably sized and configured slot opening 236 freely engageable positioned adjacent and laterally between the dispensing walls 238, which extend substantially downwardly from an underside portion of the other cylindrical component 234. In another embodiment of the toilet dispenser paper housing (not shown in the figures), the housing is instead represented by a two-halves clam-shell and hinge configuration cut along the longitudinal axis thereof. Thus, with the pair of spring biased axis end buttons 230 mounted at each longitudinal ends of a same half of the clam-shell housing, both the toilet paper roll 304 and the dust collecting component(s) 102 may be easily and simultaneously accessed from a forward side of the toilet paper dispenser housing for, respectively replacement and washing, without having to unmount the toilet paper dispenser housing from its support bracket 400. The toilet paper dispenser housing may be made of any suitable rigid material or assembly of materials commonly used in the manufacture of toilet paper dispenser housing actually on the market.

Referring to FIG. 9, typically, the toilet paper dispenser exit 204 faces downwardly in operation. In some embodiments of the invention, the upper longitudinal surface 112 of each dust filtering element 104 is bevelled, as illustrated for the dust collector 100" of FIG. 9, for example by being at least slightly slanted downwardly rearwardly from a forward edge thereof, thus forming an upwardly open ended linear recess 303 extending adjacently and substantially the whole width of the toilet paper surface 306, between the dispensing walls 238 and the dust collector 100.

Thus, advantageously as exemplified in the figure, the dust particles 300 accumulating in those recesses 303 are less likely to spill over or be thrown back towards the toilet paper surface 306 and be carried downward therewith when the toilet paper dispenser housing mounted in a toilet paper roll support bracket 400 pivots slightly back and forth when a length of toilet paper 302 is pulled therefrom.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A dispenser for dispensing toilet paper from a roll, the dispenser comprising:

an enclosure for receiving the roll of toilet paper, the enclosure defining an elongated toilet paper dispenser exit for dispensing the toilet paper therethrough;

a dust collector mounted along the toilet paper dispenser exit, the dust collector being configured to collect dust released as the toilet paper is unrolled from the roll;

wherein the dust collector and the enclosure define together a mating protrusion and recess structure for preventing movements of the dust collector relative to the dispensing walls.

2. The dispenser as defined in claim 1, wherein the enclosure defines a pair of substantially parallel dispensing walls leading to the toilet paper dispenser exit, the dust collector being received between the dispensing walls.

3. The dispenser as defined in claim 2, wherein the toilet paper dispenser exit is narrower than a thickness of the dust collector.

4. The dispenser as defined in claim 2, wherein the dust collector is removable from between the dispensing walls.

5. The dispenser as defined in claim 2, wherein, in operation, the toilet paper dispenser exit faces downwardly and the dust collector and at least one of the dispensing walls define a recess therebetween opposed to the toilet paper dispenser exit for collecting thereinto dust settling in the enclosure.

6. The dispenser as defined in claim 1, wherein the dust collector is configured and sized to abut against the toilet paper as the latter is dispensed through the toilet paper dispenser exit.

7. The dispenser as defined in claim 6, wherein the dust collector defines an abutting portion extending along the toilet paper dispenser exit for abutting against the toiler paper and a recessed portion extending substantially parallel to the abutting portion and recessed relative to the abutting portion, the recessed portion having a dust adhering surface facing the toilet paper in use configured to adhere to adjacent airborne dust.

8. The dispenser as defined in claim 7, wherein the abutting portion includes a fibrous material and the adhesive portion includes a silicone material.

9. The dispenser as defined in claim 7, wherein, in operation, the abutting portion is above the recessed portion.

10. The dispenser as defined in claim 7, wherein the abutting portion is configured to frictionally engage the toilet paper with a predetermined force, the predetermined force being sufficient to dislodge at least partially adhered dust adhered to the toilet paper as the latter is dispensed.

11. The dispenser as defined in claim 6, wherein the dust collector includes a pair of facing abutting portions extending along the toilet paper dispenser exit for pinching the toilet paper therebetween when the latter is dispensed.

12. The dispenser as defined in claim 1, wherein the dust collector is washable.

13. A dust collector mountable adjacent a toilet paper dispenser exit defined by an enclosure of a dispenser usable for dispensing toilet paper from a roll, the dust collector comprising an abutting portion for abutting against the toiler paper and a recessed portion extending substantially parallel to the abutting portion and recessed relative to the abutting portion, the recessed portion having a dust adhering surface facing the toilet paper in use and configured to adhere to adjacent airborne dust.

14. The dust collector as defined in claim 13, wherein the dust collector defines a slanted top surfaces.

15. The dust collector as defined in claim 13, wherein the abutting portion includes a fibrous material and the adhesive portion includes a silicone material.

16. The dust collector as defined in claim 13, wherein, in operation, the abutting portion is above the recessed portion.

17. The dust collector as defined in claim 13, wherein the abutting portion is configured to frictionally engage the toilet paper with a predetermined force, the predetermined force being sufficient to dislodge at least partially adhered dust adhered to the toilet paper as the latter is dispensed.

18. The dust collector as defined in claim 17, wherein the abutting portion is a first abutting portion, the dust collector including a second abutting portion facing the first abutting portion, the first and second abutting portions being configured for receiving the toilet paper therebetween when the toilet paper is dispensed and pinching the toilet paper to dislodge dust particles adhered thereto.

19. A dispenser for dispensing toilet paper from a roll, the dispenser comprising:

an enclosure for receiving the roll of toilet paper, the enclosure defining an elongated toilet paper dispenser exit for dispensing the toilet paper therethrough; and a dust collector mounted along the toilet paper dispenser exit, the dust collector being configured to collect dust released as the toilet paper is unrolled from the roll;

wherein the dust collector defines an abutting portion extending along the toilet paper dispenser exit for abutting against the toiler paper and a recessed portion extending substantially parallel to the abutting portion and recessed relative to the abutting portion, the recessed portion having a dust adhering surface facing the toilet paper in use configured to adhere to adjacent airborne dust.

* * * * *